US005303630A

United States Patent [19]

Lawrence

[11] Patent Number: 5,303,630

[45] Date of Patent: Apr. 19, 1994

[54] DOUBLE SERVE BRAIDING FOR JACKETED CABLE

[75] Inventor: Gerald W. Lawrence, Richmond, Ind.

[73] Assignee: Belden Wire and Cable Company, Richmond, Ind.

[21] Appl. No.: 875,624

[22] Filed: Apr. 28, 1992

[51] Int. Cl.[5] ..... D04C 1/00

[52] U.S. Cl. ..... 87/9; 87/6; 174/107; 174/116

[58] Field of Search ..... 87/1, 5, 6, 7, 8, 9, 87/13, 48; 147/107, 116

[56] References Cited

U.S. PATENT DOCUMENTS

| | | | |
|---|---|---|---|
| 1,718,920 | 6/1929 | Frederickson | 87/6 X |
| 2,287,947 | 6/1942 | Shoemaker | 174/107 |
| 2,585,484 | 2/1952 | Menes | 87/7 X |
| 2,924,141 | 2/1960 | Kinniburgh | 87/9 |
| 3,315,025 | 4/1967 | Tomlinson | 174/107 |
| 3,594,491 | 7/1971 | Zeidlhack | 174/107 X |
| 4,010,619 | 3/1977 | Hightower et al. | 174/107 X |
| 5,103,067 | 4/1992 | Aldissi | 174/107 X |

*Primary Examiner*—Joseph J. Hail, III
*Attorney, Agent, or Firm*—Laff, Whitesel, Conte & Saret

[57] ABSTRACT

A double serve jacketed cable that has a plurality of insulated conductors. The double serve has an outer serve wound around an inner serve and the inner and outer serve are interconnected to form a longitudinally extending french braid.

5 Claims, 2 Drawing Sheets

DOUBLE SERVE BRAIDING FOR JACKETED CABLE

BACKGROUND OF INVENTION

This invention relates to a jacketed and shielded cable formed of a plurality of cables forming an insulated core that is encased in a wire double serve shield and then provided with an extruded jacket of insulating material.

In smaller size cables there has been a high percentage of scrap generated at the double serve operation where the fine wires making up the serve have been broken or not properly retained to permit positionment and inclusion in the extrusion process forming the outer jacket. This normal double serve is basically two spiraled layers of wire going in opposite directions. There is no specific retention feature to the wire disposition.

SUMMARY OF INVENTION

A primary object of the present invention is to provide a double serve shield that will include a braided condition to more securely retain the wires in a more secure fashion than the normal double serve.

Another object of the present invention is to reduce scrap at the double serve operation by securing the frayed ends of wire, intermediate the extremities of the braid.

A further object is to keep the serve from backing up at the extrusion operation and to minimize blows.

Still another object is to improve jacket adhesion to aid in increasing the desired pull-off value of the extruded jacket.

Other objects will become apparent to those skilled in the art when the attached specification is read in conjunction with the accompanying drawings.

DETAILED SPECIFICATION

Figure 1:
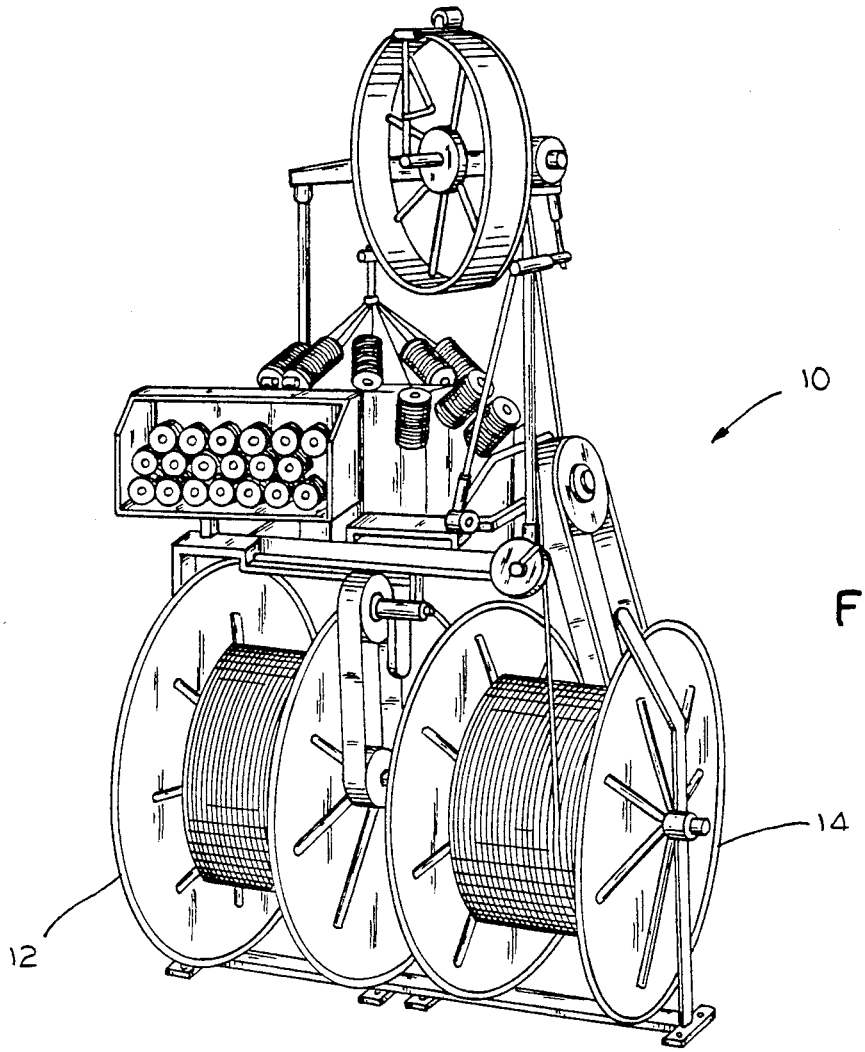
FIG. 1 is a perspective view of a braiding machine of the type commonly utilized in fabricating multiple shielding serves on cables of the type contemplated by the present invention.

Referring now to the drawings wherein similar parts are designated by similar numerals, a 16 carrier rapid braider manufactured by the WARDWELL Co. that is equipped for braiding wire can be utilized for the manufacture of the improvement of the present invention. Such a device includes at least two large reel mounting means 12 and 14, reel 12 for accepting core 20 to be braided for shielding and reel 14 for finished shielded cable ready for final encapsulation by an extruded insulating jacket. The insulated core 20 is fed axially into lower carriers 16 and thence upper carriers 18 each of which carry preferably eight carriers (bobbins) having annealed copper wire that is fed into the center thereof for encirclement of the core 20, the lower carriers 16, as seen by the lower arrows A moving clockwise while the upper carrier moves in the reverse direction, namely, counterclockwise, as seen by the upper arrows B moving counterclockwise. It will be recognized that the direction of rotation of the carriers 16 and 18, shown schematically in FIG. 3, can be equally effective if reversed to move in the opposite directions.

Figure 2A:
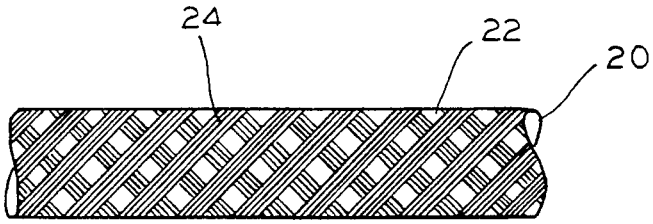
FIG. 2A (PRIOR ART)
FIG. 2A is a side elevational partial view of a prior art double serve shield.
Figure 3:
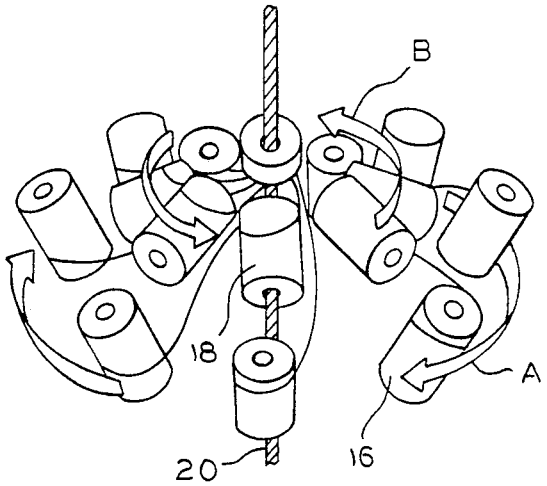
FIG. 3 (PRIOR ART)
FIG. 3 is a perspective schematic view of the arrangement of carriers (bobbins) and the path of wires as disposed to produce the prior art double serve cables.

As illustrated in FIG. 2A, the prior art consisted of an inner serve 22 and an outer serve 24 wound in opposite hands about the core 20. It has been found that when such an arrangement is fed into an extrusion apparatus for application of an extruded jacket 28 (shown in FIG. 6) there is a tendency for either the inner or outer serve to fray and become entangled in the extrusion die, thereby causing much scrap. As seen in FIG. 3, the upper carrier 18 for a standard double serve, of the type shown in FIG. 2A, the wire following a path over the lower bobbins wire path. This resulted in the double serve configuration of braid shown in FIG. 2A.

Figure 2B:
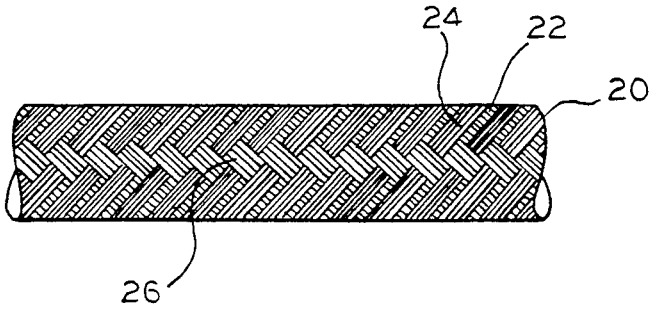
FIG. 2B is a side elevational partial external view of a preferred embodiment of the present invention.

The preferred configuration of the present invention is shown in FIG. 2B wherein the weave in of the wire from one carrier (bobbin) of inner serve with an outer serve results in the configuration shown in FIG. 2B and thereby holds both serves in place during the extruding of the final jacket 28 at the extrusion operation.

The addition of the "french" braid 26 which extends longitudinally along the cover reduces scrap at the double serve operation by tying it down securely.

Figure 4:
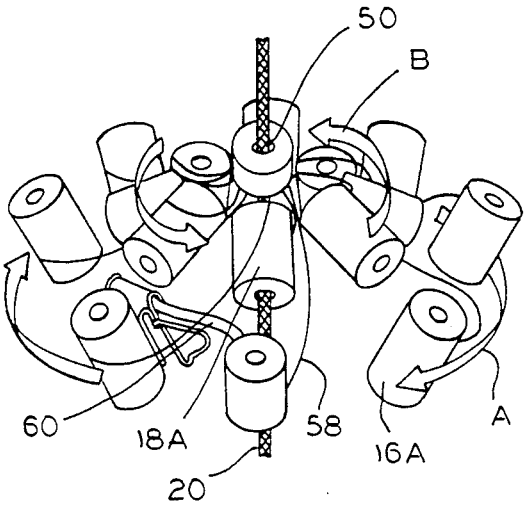
FIG. 4 is a perspective schematic view of the arrangement of carriers (bobbins) and the path of wires as disposed to produce the new improved braided double serve cables, and including one lower deflector for lower carrier that allows lower bobbins to braid at one area and will put a serve on remaining area.
Figure 4A:
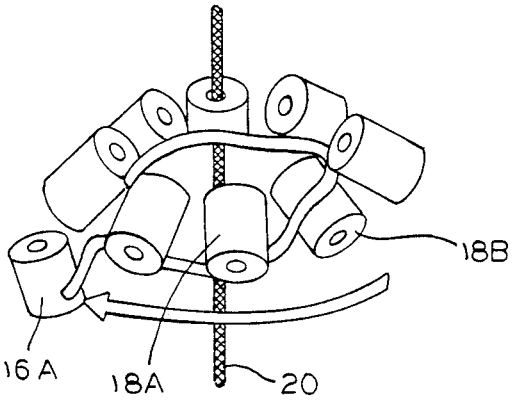
FIG. 4A is an alternate embodiment of the path of carriers for production of the improved braided double serve cables, also known as a "French" braid.
Figure 5:
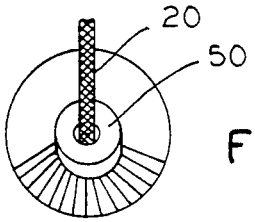
FIG. 5 is a fragmentary perspective view of a braiding guide of the type utilized for formation of the preferred embodiment.

As best seen in FIGS. 4 and 4A, the wire path of bobbins 16A for this braiding operation is over one bobbin 18B (FIG. 4A), using deflector 60 (FIG. 4) and under seven bobbins 18A. As the upper carriers travel in a counterclockwise direction, the material from bobbins 18A feeds directly to the braiding guide 50 (best seen in the blown up view FIG. 5). The material from the lower carriers 58 is fed upwardly as shown in FIG. 4.

Figure 6:
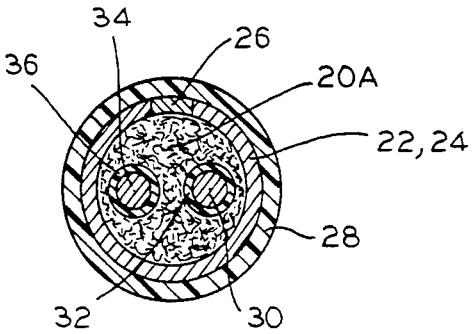
FIG. 6 is a transverse section of the completed product of the present invention.

The preferred configuration of the final cable product is seen in FIG. 6 wherein conductors 30 and 34 are insulated as at 32 and 36, respectively. The conductors may be braided or thin solid metal. While a two wire cable or independent conductors may be used they must be compatible for microphone or electronically amplified instrument usage. Thus the wire must be capable of bending freely without undue breakage. The insulated conductors are surrounded by a fibrous insulation material **20*a* that serves as a cushion as well as an insulator. This forms the core that is surrounded by the braided double serve 22,24, 26**, with the braided double serve not adding significantly to the stiffness of the wire but still being capable of withstanding the reciprocation of the beater that assists in compacting the material in the braid.

The material from the individual supply package reel 12 is braided as the upper 18 and lower 16 carriers revolve in opposite directions. Moving clockwise, the material from each lower carrier passes under seven upper carriers and is then raised by a thread deflector 60 to pass over one upper carriers. Thereafter, the material again drops and goes through the same procedure until each braiding cycle is completed.

The present invention overcomes the objections of the prior art and reduces scrap generated at double serve operations. This results in keeping the serves from backing up at the extrusion operation and minimizes the blows. An increase in jacket adhesion is realized that adds to the desired pull-off value.

Other objects will be apparent to those skilled in the art but it is my desire that the breadth of the invention be only limited by the scope of the attached claims or their equivalents.

I claim:

1. An improved double serve jacketed cable including a plurality insulated conductors disposed in an insulating core, said insulating core having a longitudinal axis, an inner metallic wire serve wound around said insulating core, an outer metallic wire serve wound around said inner serve, said inner serve and outer serve interconnected in a single weave forming a single longitudinally extending french braid to form a double serve, and an extruded insulating jacket encompassing and insulating the double serve.

2. A cable as claimed in claim 1 wherein there are two insulated conductors in said core.

3. A cable as claimed in claim 2 wherein said conductors are solid wire.

4. A cable as claimed in claim 1 wherein said conductors are braided wire.

5. A cable including at least a pair of insulated conductors disposed within a fibrous insulating material core, a double serve magnetically shielded means having namely, an inner and an outer serve, wound in opposite hands about said core and one carrier of inner serve woven into said outer serve to form a single longitudinally extending french braid to hold said two serves in place during an extrusion operation that creates an outer insulated flexible jacket.

* * * * *